US007126543B2

(12) United States Patent
Tang et al.

(10) Patent No.: US 7,126,543 B2
(45) Date of Patent: Oct. 24, 2006

(54) PLANAR MONOPOLE ANTENNA

(75) Inventors: Chia-Lun Tang, Sanyi Township, Miaoli County (TW); Kin-Lu Wong, Kaohsiung (TW); Chih-Hsien Wu, Taipei (TW); Saou-Wen Su, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/114,548

(22) Filed: Apr. 26, 2005

(65) Prior Publication Data

US 2006/0176233 A1 Aug. 10, 2006

(30) Foreign Application Priority Data

Feb. 4, 2005 (TW) ..... 94103685 A

(51) Int. Cl.
*H01Q 1/38* (2006.01)

(52) U.S. Cl. ..... 343/700 MS

(58) Field of Classification Search ..... 343/700 MS, 343/826, 830, 831
See application file for complete search history.

(56) References Cited

U.S. PATENT DOCUMENTS 4,466,003 A 8/1984 Royce ..... 343/826
5,146,232 A * 9/1992 Nishikawa et al. ..... 343/713
5,828,340 A 10/1998 Johnson ..... 343/700
6,339,409 B1 1/2002 Warnagiris ..... 343/895
6,781,546 B1 * 8/2004 Wang et al. ..... 343/700 MS
6,958,732 B1 * 10/2005 Yuanzhu ..... 343/702

OTHER PUBLICATIONS

Wideband Monopole Antennas For Multi-Band Wireless Systems M. J. Ammann and Zhi Ning Chen, vol. 45, No. 2, Apr. 2003 pp. 146-150.

* cited by examiner

*Primary Examiner*—Trinh Vo Dinh

(57) ABSTRACT

A planar monopole antenna is provided. The planar monopole antenna comprises a ground plate, a radiating metal plate, and a multi-branch feeding metal plate. The multi-branch feeding metal plate is formed between the ground plate and the radiating metal plate, and has a single feeding point thereon. The radiating metal plate and the multi-branch feeding metal plate together can also be fabricated from a single metal plate by using a line-cutting or stamping technique, or formed on a same dielectric substrate by using a printing or etching technique. Thus, the planar monopole antenna is easy to construct at a low cost.

13 Claims, 9 Drawing Sheets

PLANAR MONOPOLE ANTENNA

FIELD OF THE INVENTION

The present invention generally relates to an antenna, and more specifically to a planar monopole antenna.

BACKGROUND OF THE INVENTION

As the digital audio and video technologies progress and numerous mobile communication products are developed, the transmission speed and the amount of data transmitted using wireless communication are both increasing. For the related applications, the IEEE 802.15 Wireless Personal Area Network (WPAN) standard designates an ultra-wide band of 3.1 to 10.6 GHz for high data-rate transmission to meet the needs of future technologies. In the antenna design for this kind of ultra-wideband antenna, it is highly valuable to obtain a design that has an operational bandwidth with a frequency ratio exceeding 1:7.5. Most of the current wide-band antennas are monopole antenna, logarithm periodic antenna, and so on. However, these designs do not satisfy the ultra-wideband operation and are usually bulky in design.

In 1982, U.S. Pat. No. 4,466,003 disclosed a monopole antenna, including a plurality of metal rods having different lengths. The antenna can generate a plurality of resonant frequencies, but the disadvantages are that it has a complex structure and is large in size. In 1996, U.S. Pat. No. 5,828,340 disclosed a wideband monopole antenna. However, the increased bandwidth does not satisfy the needs nowadays.

FIG. 1 shows a schematic view of a conventional wide-band monopole antenna. A wideband monopole antenna 100 uses a single feeding strip 130 to connect to a radiating metal plate 120. One end of feeding strip 130 is connected to a signal source (not shown) through a via-hole 140 on a ground plate 110. This type of wideband monopole antenna has the disadvantage of insufficient bandwidth, usually less than 2 GHz. Furthermore, for frequencies over the operating band, the cross-polarization radiation of the antenna is too large.

SUMMARY OF THE INVENTION

The present invention has been made to overcome the aforementioned drawback of conventional wideband monopole antennas. The primary object of the present invention is to provide a planar monopole antenna for improving the insufficient bandwidth problem to meet the needs of ultra-wideband operation.

The planar monopole antenna of the present invention includes a ground plate, a radiating metal plate and a multi-branch feeding metal plate. The ground plate has a via-hole. The radiating metal plate, located above the ground plate, has a plurality of connection points. The multi-branch feeding metal plate is located between the ground plate and the radiating metal plate, and is connected to the radiating metal plate with the plurality of connection points. The multi-branch feeding metal plate has a feeding point, and the feeding point is embedded into the via-hole of the ground plate and is electrically connected to a signal source.

The multi-branch feeding metal plate includes a plurality of branch metal arms, a connecting metal arm, and a feeding metal arm. Each branch metal arm has a first end and a second end. The first end of each metal arm is connected to the corresponding connection point of the radiating metal plate. The connecting metal arm has two ends, which are connected to the second ends of two of the branch metal arms. The two ends of the remaining branch metal arms are connected to the radiating metal plate and connecting metal arm, and are located between two branch metal arms. The feeding metal arm has two ends. One end is embedded in the via-hole and is electrically connected to the signal; the other is connected to the center of the connecting arm.

The planar monopole antenna of the present invention uses a multi-branch feeding metal plate, and the operating bandwidth can be an ultra-wide band with a frequency ratio greater than 1:7.5. Furthermore, for frequencies over the operating band, the cross-polarization (horizontal-polarization) radiation of the antenna is less than −15 dB, so that the intensity of the vertical polarization is raised. The present invention also has the advantage of structural simplicity, and is easy to manufacture. The radiating metal plate and the multi-branch feeding metal plate together can also be fabricated from a single metal plate by using a line-cutting or stamping technique, or formed on a same dielectric substrate by using a printing or etching technique. In summary, the ultra-wideband operation mechanism of the present invention is simple and clear. The present invention is able to improve the drawbacks of insufficient bandwidth of the conventional antenna and meet the ultra-wideband needs at a low manufacturing cost.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
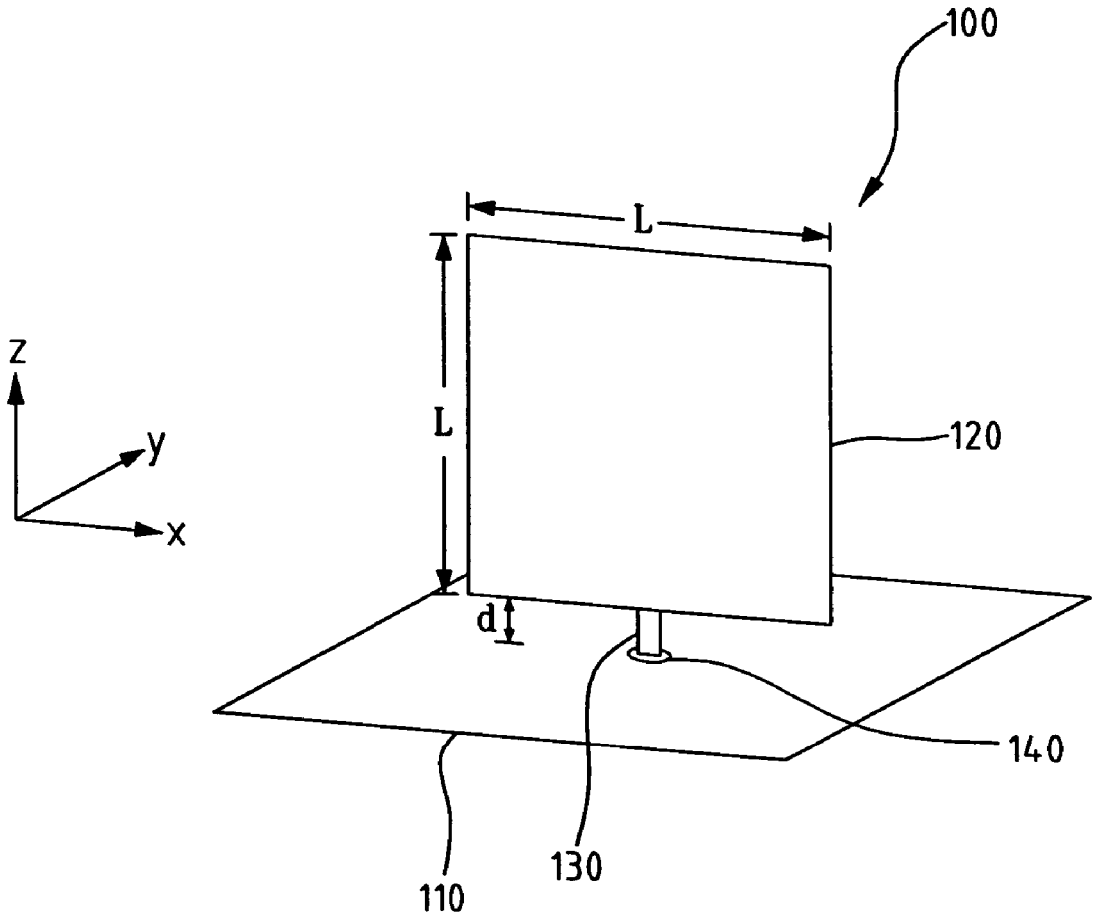
FIG. 1 (PRIOR ART)
FIG. 1 shows a schematic view of the structure of a conventional wideband monopole antenna.
Figure 2A:
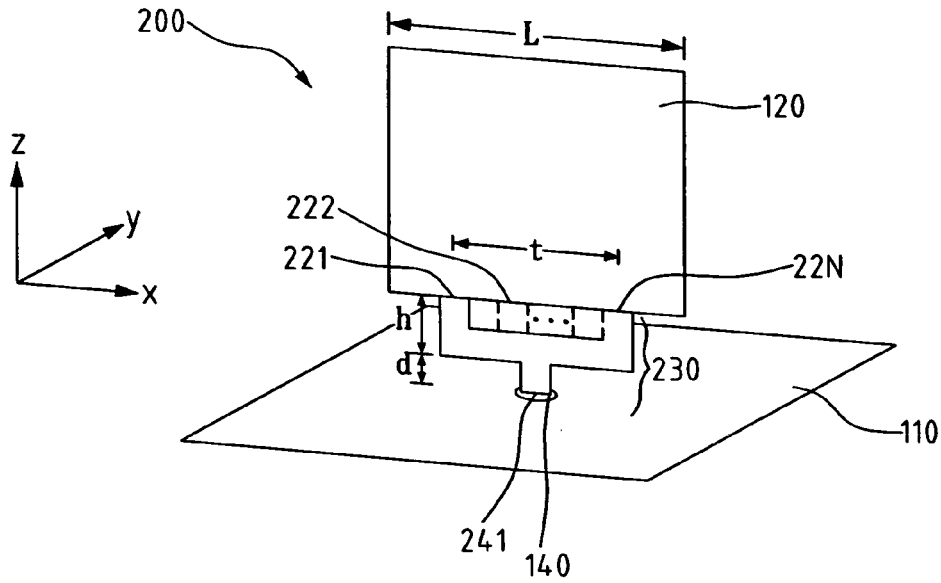
FIG. 2A shows a schematic view of the structure of a planar monopole antenna of the present invention.

FIG. 2A shows a schematic view of the structure of a planar monopole antenna of the present invention. As shown in FIG. 2A, a planar monopole antenna 200 comprises a ground plate 110, a radiating metal plate 120 and a multi-branch feeding metal plate 230. Ground plate 110 has a via-hole 140. Radiating metal plate 120, located above ground plate 110, has a plurality of connection points 221–22N. Multi-branch feeding metal plate 230 is located between ground plate 110 and radiating metal plate 120, and is connected to radiating metal plate 120 with the plurality of connection points 221-22N. Multi-branch feeding metal plate 230 has a feeding point 241, and feeding point 241 is embedded into via-hole 140 of ground plate 110 and is electrically connected to a signal source (not shown).

Figure 2B:
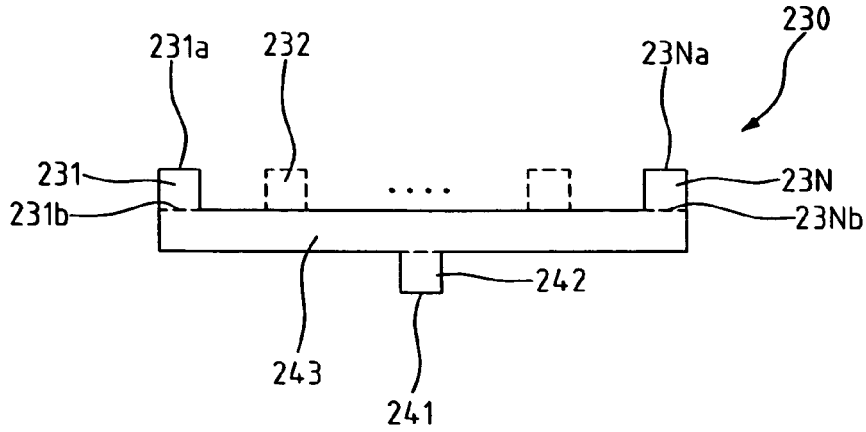
FIG. 2B shows a schematic view of the structure of a multi-branch feeding metal plate of the present invention.

FIG. 2B shows a schematic view of the structure of a multi-branch feeding metal plate of the present invention. As shown in FIG. 2B, multi-branch feeding metal plate 230 comprises a plurality of branch metal arms 231–23N, a connecting metal arm 243, and a feeding metal arm 242. Each branch metal arm has a first end 23Na and a second end 23Nb. First end 23Na of each branch metal arm is connected to the corresponding connection point 22N of radiating metal plate 120. Connecting metal arm 243 has two ends, which are connected to second ends 231b, 23Nb of two of the branch metal arms 231, 23N. The two ends of the remaining branch metal arms 232~23(N-1) are connected to radiating metal plate 120 and connecting metal arm 243, and are located between two branch metal arms 231, 23N. Feeding metal arm 242 has two ends. One end is embedded in via-hole 140 and is electrically connected to the signal source (not shown); the other is connected to the center of connecting arm 243.

Without loss of generality, the following embodiments use N=2, and N=3, respectively, to describe the structure of the present invention.

Figure 3A:
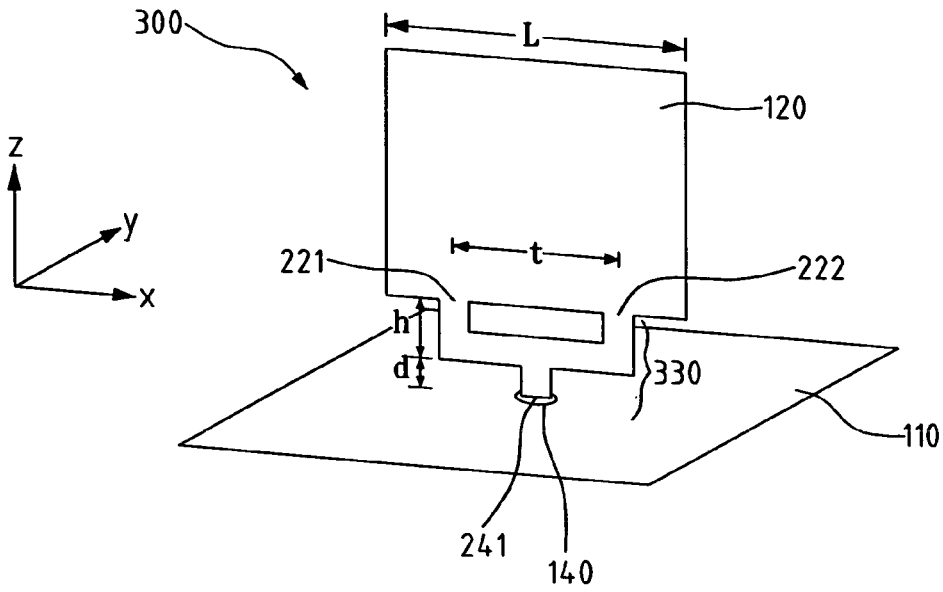
FIG. 3A shows a schematic view of the structure of a first embodiment of the present invention.

FIG. 3A shows a schematic view of the structure of a first embodiment (N=2) of the present invention. As shown in FIG. 3A, a planar monopole antenna 300 comprises a ground plate 110, a radiating metal plate 120 and a two-branch feeding metal plate 330. Radiating metal plate 120, located above ground plate 110, has two connection points 221, 222. Two-branch feeding metal plate 330 is located between ground plate 110 and radiating metal plate 120, and is connected to radiating metal plate 120 with connection points 221, 222. Two-branch feeding metal plate 330 has a feeding point 241, and feeding point 241 is embedded into via-hole 140 of ground plate 110 and is electrically connected to a signal source (not shown).

Figure 3B:
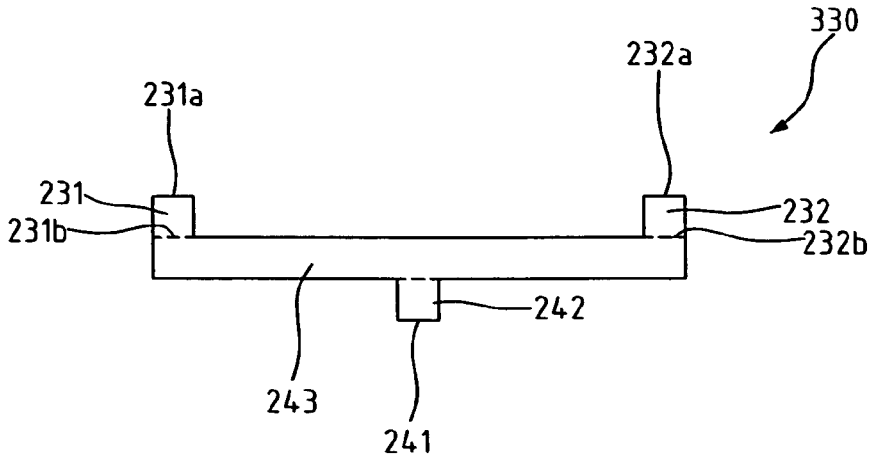
FIG. 3B shows a schematic view of the structure of a two-branch feeding metal plate of the present invention.

FIG. 3B shows a schematic view of the structure of a two-branch feeding metal plate of the present invention. As shown in FIG. 3B, two-branch feeding metal plate 330 includes two branch metal arms 231, 232, a connecting metal arm 243, and a feeding metal arm 242. Branch metal arm 231 has a first end 23 la and a second end 231*b*, roughly perpendicular to ground plate 110. First end 231*a* of branch metal arm 231 is connected to connection point 221 of radiating metal plate 120. Branch metal arm 232 has a first end 232*a* and a second end 232*b*, roughly perpendicular to ground plate 110. First end 232*a* of branch metal arm 232 is connected to connection point 222 of radiating metal plate 120. Connecting metal arm 243 is roughly parallel to ground plate 110, and has two ends, with one connected to second end 231*b* of branch metal arm 231 and the other connected to second end 232*b* of branch metal arms 232. Feeding metal arm 242 is roughly perpendicular to ground plate 110. Feeding point 241 is located at one end of feeding metal arm 242 and also located on via-hole 140 of ground plate 110, and is electrically connected to the signal source (not shown). The other end of feeding metal arm 242 is connected to the center of connecting arm 243.

Figure 4:
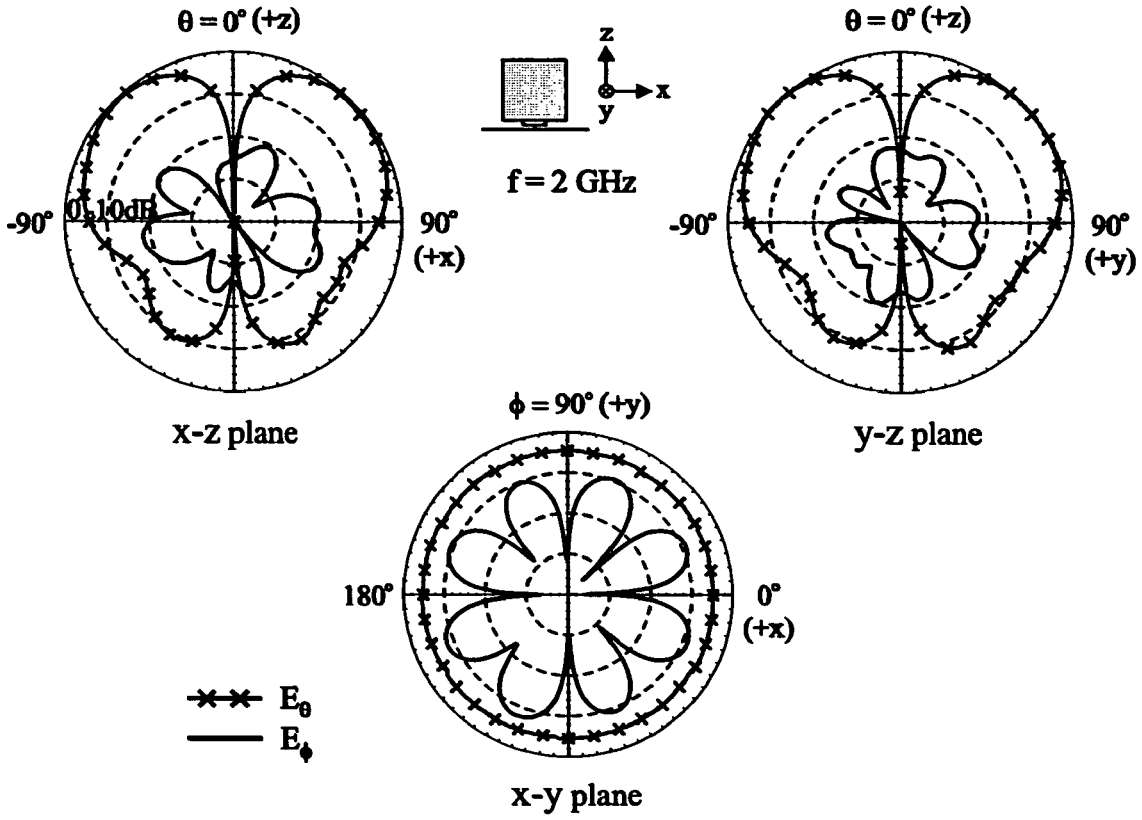
FIG. 4 shows the result of the radiation pattern measurement of a first embodiment of the present invention at 2 GHz.
Figure 5:
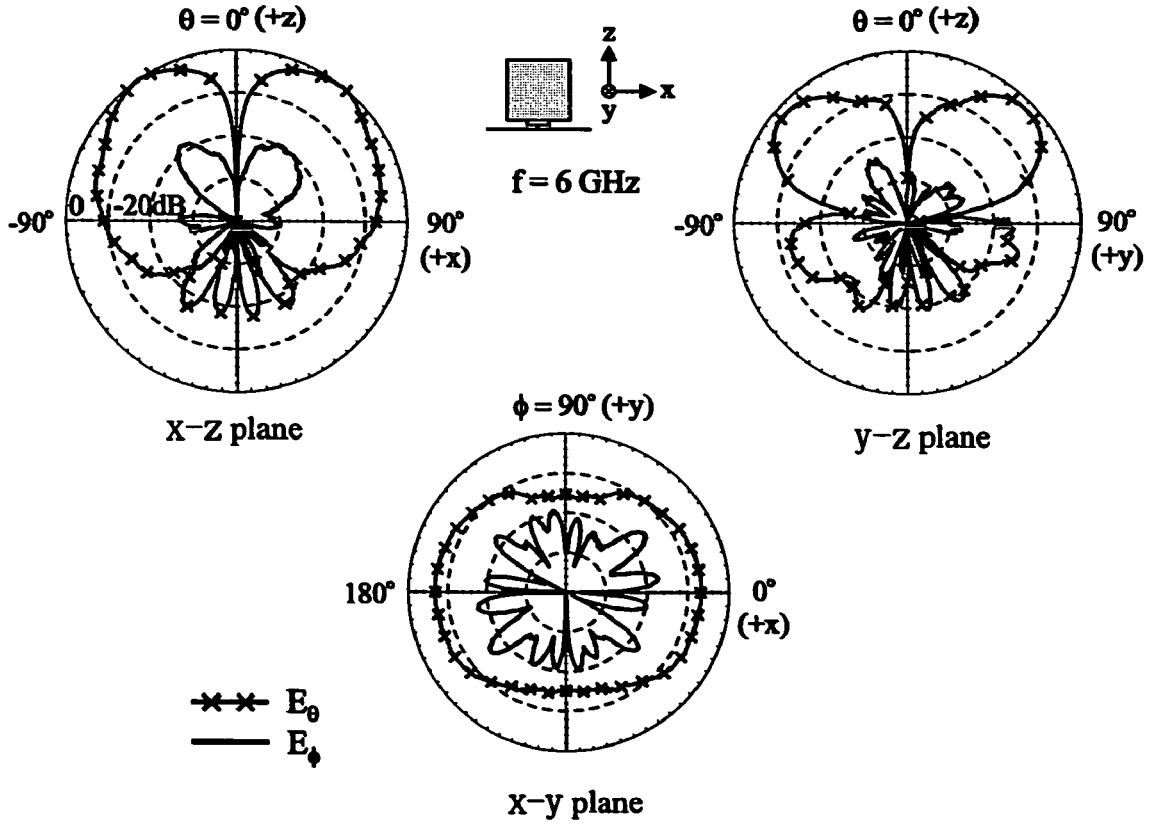
FIG. 5 shows the result of the radiation pattern measurement of a first embodiment of the present invention at 6 GHz.
Figure 6:
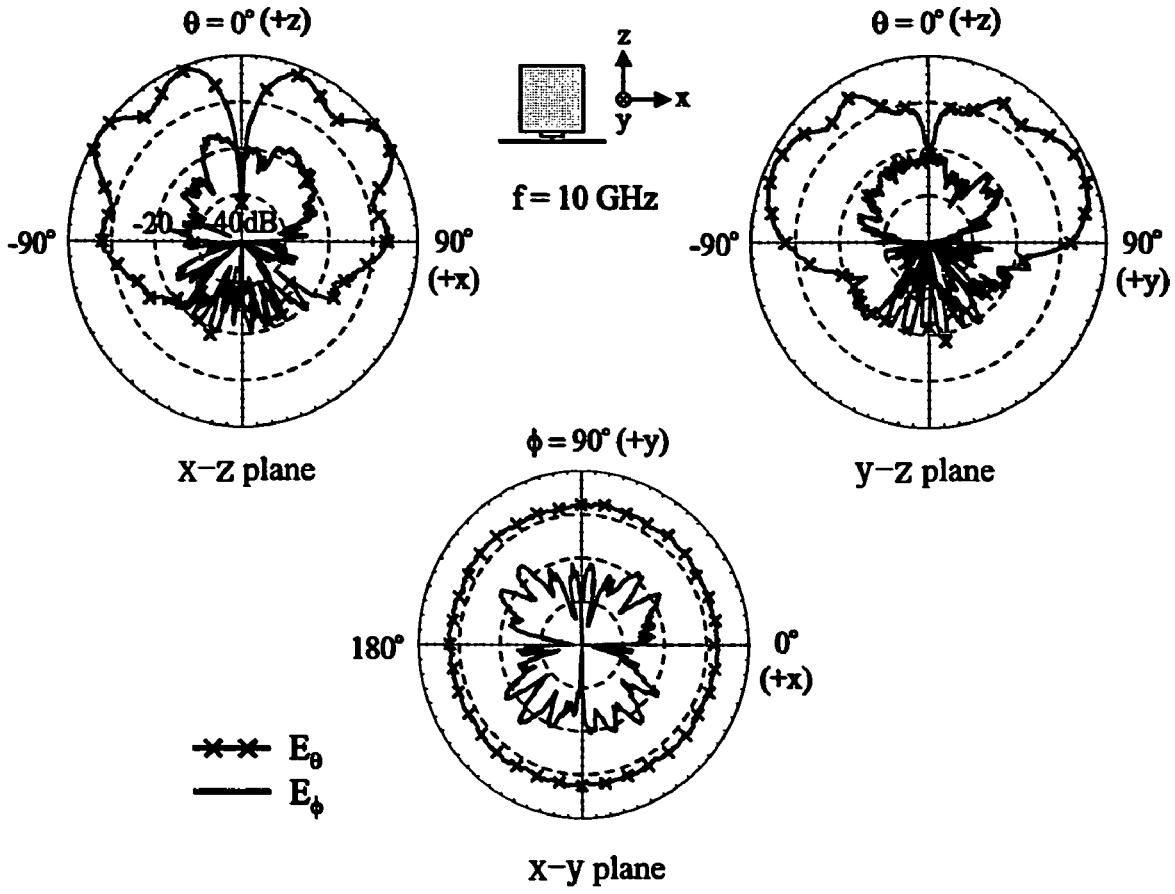
FIG. 6 shows the result of the radiation pattern measurement of a first embodiment of the present invention at 10 GHz.

FIG. 4, FIG. 5, and FIG. 6 show the results of the antenna radiation pattern measurement of the first embodiment at 2 GHz, 6 GHz, and 10 GHz, respectively. Monopole-like radiation patterns are obtained, and the cross-polarization levels, defined as the ratio between the maximum cross-polarization and the maximum co-polarization, are all less than −15 dB.

Figure 7:
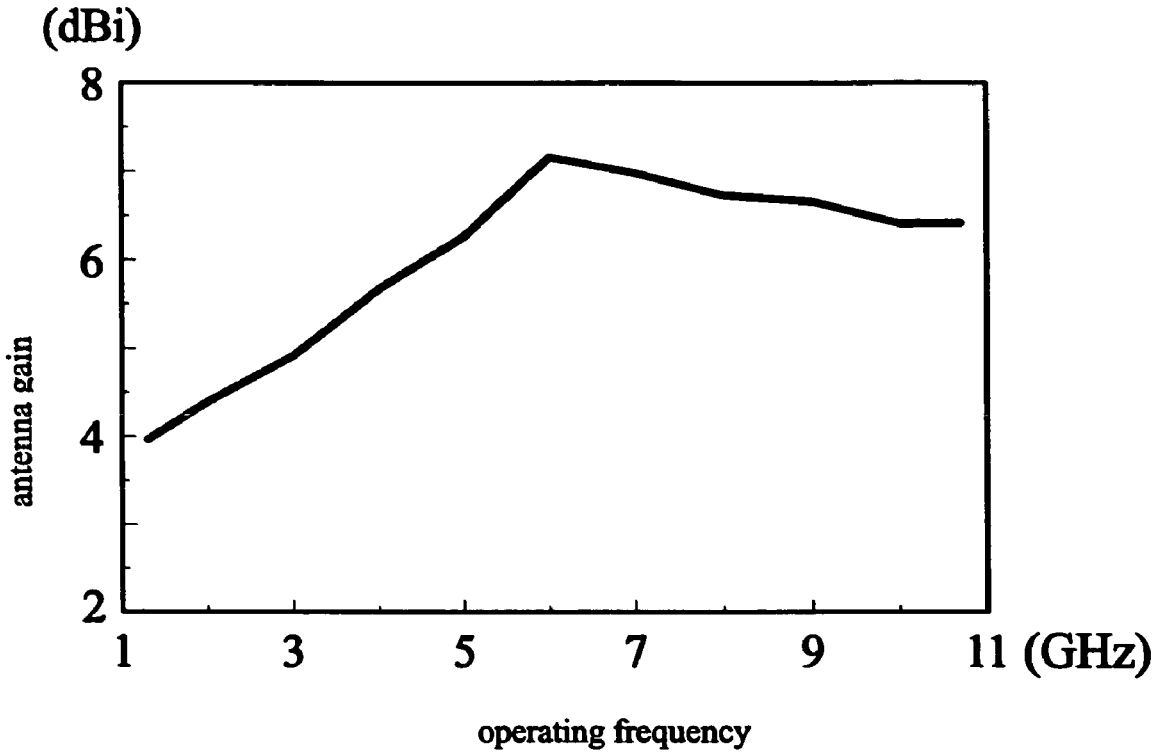
FIG. 7 shows the result of the antenna gain measurement of a first embodiment of the present invention over the operating band.

FIG. 7 shows the result of the antenna gain of the first embodiment over the operating band. As shown in FIG. 7, the vertical-axis indicates the antenna gain, and the horizontal-axis is the operating frequency. As the results show, the gain is about 4.0–7.1 dBi over the operating band.

Figure 8A:
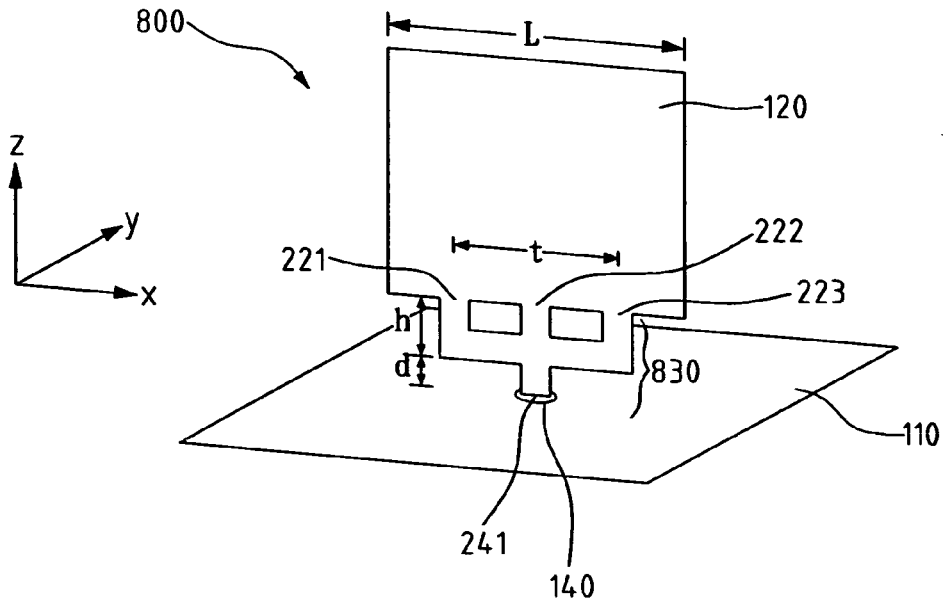
FIG. 8A shows a schematic view of the structure of a second embodiment (N=3) of the present invention.

FIG. 8A shows a schematic view of the structure of a second embodiment (N=3) of the present invention. As shown in FIG. 8A, a planar monopole antenna 800 includes a ground plate 110, a radiating metal plate 120 and a three-branch feeding metal plate 830. The structure of the second embodiment is similar to that of the first embodiment, except that radiating metal plate 120 has three connection points 221, 222, 223. Three-branch feeding metal plate 830 is connected to radiating metal plate 120 through connection points 221, 222, 223.

Figure 8B:
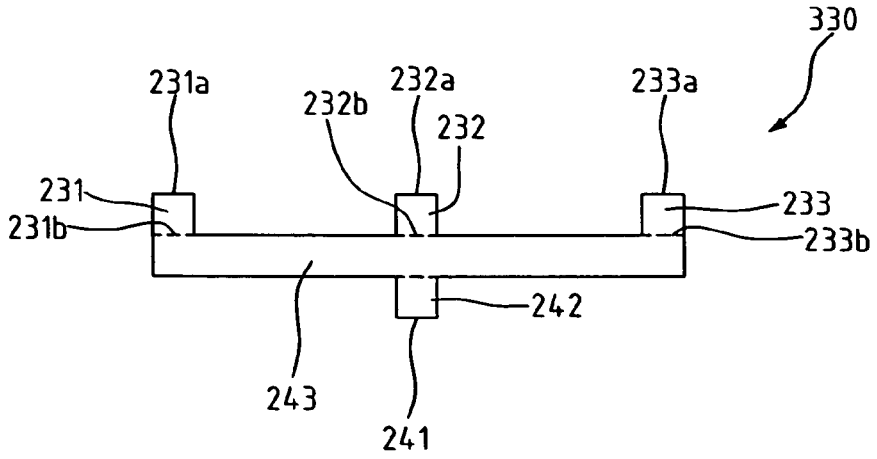
FIG. 8B shows a schematic view of the structure of a three-branch feeding metal plate of the present invention.

FIG. 8B shows a schematic view of the structure of a three-branch feeding metal plate of the present invention. Three-branch feeding metal plate 830 has the similar structure to two-branch feeding metal plate 330, except that three-branch feeding metal plate 830 has three branch metal arms. As shown in FIG. 8B, three-branch feeding metal plate 830 includes three branch metal arms 231, 232, 233, a connecting metal arm 243 and a feeding metal arm 242. First end 231 a of branch metal arm 231, first end 232*a* of branch metal arm 232, and first end 233*a* of branch metal arm 233 are connected to radiating metal plate 120 through connection points 221, 222, 223, respectively. Connecting metal arm 243 is roughly parallel to ground plate 110, and has two ends, with one connected to second end 231*b* of branch metal arm 231 and the other connected to second end 233*b* of branch metal arms 233. Second end 232*b* of branch metal arm 232 is connected to the center of connecting metal arm 243. Branch metal arms 231, 232, 233 are roughly parallel to each other. Branch metal arm 232 is roughly located between branch metal arm 231 and branch metal arm 233, and equally distanced from branch metal arms 231, 233.

It is worth noticing that the lowest operating frequency can be controlled by adjusting the length L of radiating metal plate 120. Length L is roughly ⅙ of the wavelength of the lowest frequency. In addition, as shown in FIG. 2B, a good impedance matching over the operating frequency range can be obtained by adjusting the distance t between branch metal arms 231, 23N, the height d of connecting metal arm 243, and the height h from connection point 221 to the bottom of connecting metal arm 243.

Figure 9:
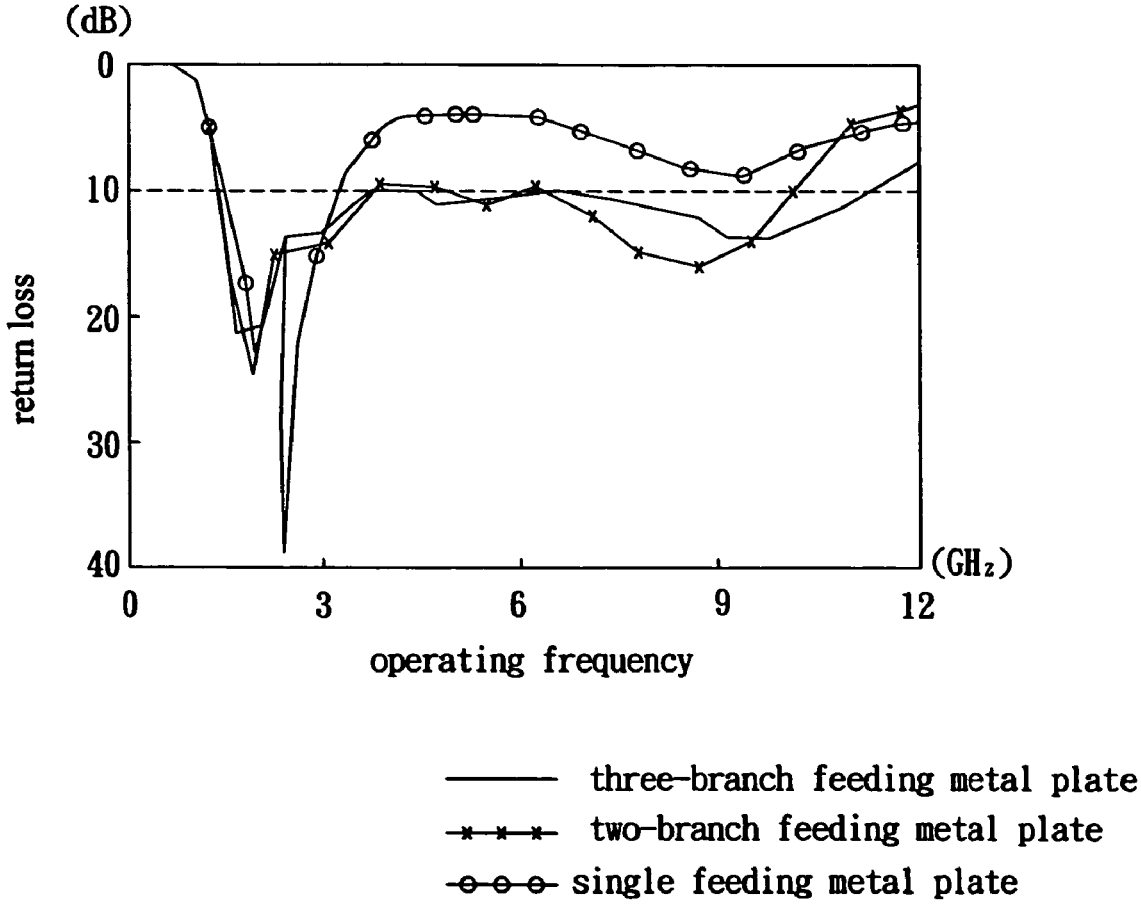
FIG. 9 shows the comparison between the return loss of the planar monopole antenna with two-branch and three-branch and that of the conventional planar monopole antenna.

FIG. 9 shows the comparison between the return loss of a planar monopole antenna with a three-branch or a two-branch feeding metal plate and that of a conventional planar monopole antenna with a single feeding metal plate. The following dimensions are selected for the experiments: ground plate 110 is a rectangle having the length of 150 mm, radiating metal plate 120 having the length of 40 mm. The width of two-branch feeding metal plate 330 and the width of three-branch feeding metal plate 830 are both 2 mm.

Branch metal arms 231, 232, 233 have the length of 1 mm. The length of connecting metal arm 243 is 17 mm and the length of feeding metal arm 242 is 1 mm. The comparison is made among a planar monopole antenna with a three-branch feeding metal plate (t=15 mm, h=3.5 mm, d=1.0 mm), a planar monopole antenna with a two-branch feeding metal plate (t=15 mm, h=3.5 mm, d=1.0 mm), and a conventional planar monopole antenna with a single feeding metal plate (d=2.5 mm). A shown in FIG. 9, the vertical-axis shows the return loss and the horizontal-axis is the operating frequency. For the 10 dB return loss, antenna 800 with the three-branch feeding metal plate shows an ultra-wide operating frequency range of 1.4 GHz to 11.1 GHz, and the frequency ratio ($f_U/f_L$, ratio of the 10 dB return-loss upper edge frequency to the 10 dB return-loss lower edge frequency of the bandwidth) is about 1:7.9. Antenna 300 with the two-branch feeding metal plate shows an ultra-wide operating frequency range of 1.3 GHz to 10.1 GHz, and the frequency ratio is about 1:7.7. Antenna 100 with the single feeding metal plate shows an ultra-wide operating frequency range of 1.5 GHz to 3.3 GHz, and the frequency ratio is about 1:2.2.

According to the present invention, multi-branch feeding metal plate 230 makes the surface current in the perpendicular direction (perpendicular to ground plate 110) on radiating metal plate 120 more uniform and easier to be excited. Therefore, it can be expected that the surface current in the perpendicular direction is larger than the horizontal direction (parallel to ground plate 110). The vertical polarization purity of the antenna is thus greatly increased, and cross-polarization level is reduced and less than −15 dB. According to the present invention, three-branch feeding metal plate 830, in comparison with two-branch feeding metal plate 330, can make the surface current in the perpendicular direction on radiating metal plate 120 more uniformly distributed and obtain a higher vertical polarization purity of the antenna. Therefore, the operating frequency range of antenna 800 with a three-branch feeding metal plate is greater than that of antenna 300 with a two-branch feeding metal plate, which in turn is greater than that of antenna 100 with a single feeding metal plate.

In addition, radiating metal plate 120 and multi-branch feeding metal plate 230 together can be fabricated from a single metal plate by using a line-cutting or stamping technique, or formed on a same dielectric substrate by using a printing or etching technique. In conclusion, the antenna of the present invention is simple in structure, is easy to manufacture, and has a clear ultra-wideband operating mechanism. Thereby, it overcomes the drawbacks of the conventional antenna, meets the ultra-wideband demands, and is easy to construct at a low cost.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A planar monopole antenna, comprising:

a ground plate having a via-hole;

a radiating metal plate located above said ground plate and having a plurality of connection points; and a multi-branch feeding metal plate having a feeding point, located between said ground plate and said radiating metal plate, connected to said radiating metal plate through said plurality of connection points, and connected to said ground plate through embedding said feeding point in said via-hole and electrically connected to a signal source;

wherein said multi-branch feeding metal plate and said radiating metal plate are substantially on a same plane.

2. The planar monopole antenna as claimed in claim 1, wherein said plurality of connection points are located symmetrically on both sides of the center of said radiating metal plate.

3. The planar monopole antenna as claimed in claim 1, wherein said ground plate and said radiating metal plate are perpendicular to each other.

4. The planar monopole antenna as claimed in claim 1, wherein said radiating metal plate and said multi-branch feeding metal plate are formed on a single metal sheet.

5. The planar monopole antenna as claimed in claim 1, wherein said radiating metal plate and said multi-branch feeding metal plate are formed on a same dielectric substrate.

6. The planar monopole antenna as claimed in claim 1, wherein said radiating metal plate is square.

7. A planar monopole antenna, comprising:

a ground plate having a via-hole;

a radiating metal plate located above said ground plate and having a plurality of connection points; and a multi-branch feeding metal plate having a feeding point, located between said ground plate and said radiating metal plate, connected to said radiating metal plate through said plurality of connection points, and connected to said ground plate through embedding said feeding point in said via-hole and electrically connected to a signal source;

wherein said multi-branch feeding metal plate further comprises:

a plurality of branch metal arms, each having a first end and a second end, said first end of each branch metal arm being connected to a corresponding connection point of said radiating metal plate;

a connecting metal arm having two ends, the second ends of two outermost branch metal arms of said plurality of branch metal arms being connected to said two ends of said connecting metal arm, the first and second ends of remaining branch metal arms of said plurality of branch metal arms being connected to said radiating metal plate and said connecting metal arm respectively, and being located separately between said two outermost branch metal arms; and a feeding metal arm having a first end being embedded into said via-hole and electrically connected to said signal source, and a second end being connected to the center of said connecting metal arm.

8. The planar monopole antenna as claimed in claim 7, wherein said plurality of branch metal arms have identical length.

9. The planar monopole antenna as claimed in claim 7, wherein said feeding metal plate and said ground plate are perpendicular to each other.

10. The planar monopole antenna as claimed in claim 7, wherein said connecting metal arm is approximately parallel to said ground plate.

11. The planar monopole antenna as claimed in claim 7, wherein said plurality of branch metal arms are perpendicular to said ground plate.

12. The planar monopole antenna as claimed in claim 7, wherein said plurality of branch metal arms are parallel to one another.

13. The planar monopole antenna as claimed in claim 12, wherein said plurality of branch metal arms are located above said connecting metal arm with equal distance from each other.

* * * * *